US012569897B2

(12) United States Patent
Shingaki et al.

(10) Patent No.: US 12,569,897 B2
(45) Date of Patent: Mar. 10, 2026

(54) PRODUCTION METHOD FOR GRAIN-ORIENTED ELECTRICAL STEEL SHEET, AND PRODUCTION LINE

(71) Applicant: JFE STEEL CORPORATION, Tokyo (JP)

(72) Inventors: Yukihiro Shingaki, Tokyo (JP); Yusuke Shimoyama, Tokyo (JP); Ayaka Sera, Tokyo (JP)

(73) Assignee: JFE STEEL CORPORATION, Chiyoda-ku (JP)

( * ) Notice: Subject to any disclaimer, the term of this patent is extended or adjusted under 35 U.S.C. 154(b) by 364 days.

(21) Appl. No.: 18/003,499

(22) PCT Filed: Jun. 28, 2021

(86) PCT No.: PCT/JP2021/024423
§ 371 (c)(1),
(2) Date: Dec. 28, 2022

(87) PCT Pub. No.: WO2022/004677
PCT Pub. Date: Jan. 6, 2022

(65) Prior Publication Data

US 2023/0243009 A1 Aug. 3, 2023

(30) Foreign Application Priority Data

Jun. 30, 2020 (JP) ..... 2020-113542

(51) Int. Cl.
*B21B 37/46* (2006.01)
*C21D 1/34* (2006.01)
(Continued)

(52) U.S. Cl.
CPC ..... *B21B 37/46* (2013.01); *C21D 1/34* (2013.01); *C21D 8/1233* (2013.01);
(Continued)

(58) Field of Classification Search
CPC ..... B21B 37/46; C21D 9/0056; C21D 9/46; C21D 11/00
See application file for complete search history.

(56) References Cited

U.S. PATENT DOCUMENTS 3,933,024 A 1/1976 Matsumoto et al.
2009/0032142 A1 2/2009 Kumano et al.
(Continued)

FOREIGN PATENT DOCUMENTS

CN 101395284 A 3/2009
CN 105579596 A 5/2016
(Continued)

OTHER PUBLICATIONS

RU 2735643 C1 machine translation (Year: 2020).*
(Continued)

*Primary Examiner* — Tima M. McGuthry-Banks
(74) *Attorney, Agent, or Firm* — KENJA IP LAW PC

(57) ABSTRACT

Provided is a production method for a grain-oriented electrical steel sheet with which stable magnetic properties are obtained in the same coil. The method comprises: hot rolling a steel slab having a predetermined chemical composition, followed by annealing to obtain a hot-rolled and annealed sheet; cold rolling the hot-rolled and annealed sheet one time, or two times or more with intermediate annealing being performed therebetween, to obtain a cold-rolled sheet, followed by subjecting to primary and secondary recrystallization annealing, wherein in the cold rolling, a rolling reduction ratio is 80% or more at least one time out of the one time or two times or more, and a steel sheet temperature $T_0$ (° C.) while a rolling rate is a set value $R_0$ (mpm) and a steel sheet temperature $T_1$ (° C.) while the rolling rate is less than or equal to $0.5 \times R_0$ (mpm) satisfy a formula (1).

2 Claims, 2 Drawing Sheets

(51) Int. Cl.

| | |
|---|---|
| ***C21D 8/12*** | (2006.01) |
| ***C21D 8/1216*** | (2026.01) |
| ***C21D 9/00*** | (2006.01) |
| ***C21D 9/46*** | (2006.01) |
| ***C21D 11/00*** | (2006.01) |
| ***C22C 38/02*** | (2006.01) |
| ***C22C 38/04*** | (2006.01) |
| ***C22C 38/08*** | (2006.01) |

(52) U.S. Cl.

CPC ..... *C21D 9/0056* (2013.01); *C21D 9/46* (2013.01); *C21D 11/00* (2013.01); *C22C 38/02* (2013.01); *C22C 38/04* (2013.01); *C22C 38/08* (2013.01); *C21D 2201/05* (2013.01)

(56) References Cited

U.S. PATENT DOCUMENTS

| | | | | |
|---|---|---|---|---|
| 2009/0101248 | A1 | 4/2009 | Shingaki et al. | |
| 2016/0196909 | A1 | 7/2016 | Takenaka et al. | |
| 2019/0271054 | A1 | 9/2019 | Ehashi et al. | |
| 2020/0032363 | A1* | 1/2020 | Ko | C21D 8/1222 |
| 2020/0230673 | A1 | 7/2020 | Fukushima | |
| 2021/0062309 | A1* | 3/2021 | Kim | C21D 8/0236 |
| 2022/0033921 | A1 | 2/2022 | Shingaki et al. | |
| 2022/0389532 | A1* | 12/2022 | Ko | C21D 8/1205 |
| 2023/0080012 | A1* | 3/2023 | Matsubara | B21C 49/00 72/200 |

FOREIGN PATENT DOCUMENTS

| | | | | |
|---|---|---|---|---|
| CN | 108699621 | A | 10/2018 | |
| CN | 110479759 | A | 11/2019 | |
| EP | 3590614 | A1 | 1/2020 | |
| JP | S5016610 | A | 2/1975 | |
| JP | S546845 | A | 1/1979 | |
| JP | H01215925 | A | 8/1989 | |
| JP | H02112818 | A | 4/1990 | |
| JP | H08253816 | A | 10/1996 | |
| JP | H11106826 | A | 4/1999 | |
| JP | H11335736 | A | 12/1999 | |
| JP | 2000129356 | A | 5/2000 | |
| JP | 2003253335 | A | 9/2003 | |
| JP | 2015190022 | A | 11/2015 | |
| RU | 2735643 | C1 * | 11/2020 | B21B 1/46 |
| TW | 200627482 | A | 8/2006 | |
| TW | 201838731 | A | 11/2018 | |
| WO | 2020067236 | A1 | 4/2020 | |

OTHER PUBLICATIONS

Jun. 27, 2024, the Extended European Search Report issued by the European Patent Office in the corresponding European Patent Application No. 21833708.7.

Mar. 22, 2024, the Partial Supplementary European Search Report issued by the European Patent Office in the corresponding European Patent Application No. 21833708.7.

Jan. 22, 2022, Office Action issued by the Taiwan Intellectual Property Office in the corresponding Taiwanese Patent Application No. 110123859 with English language Search Report.

Nov. 15, 2022, Notification of Reasons for Refusal issued by the Japan Patent Office in the corresponding Japanese Patent Application No. 2021-560750 with English language Concise Statement of Relevance.

Sep. 7, 2021, International Search Report issued in the International Patent Application No. PCT/JP2021/024423.

Oct. 17, 2024, Office Action issued by the Korean Intellectual Property Office in the corresponding Korean Patent Application No. 10-2022-7045929 with English language concise statement of relevance.

Feb. 27, 2025, Office Action issued by the China National Intellectual Property Administration in the corresponding Chinese Patent Application No. 202180045758.5 with English language search report.

* cited by examiner

PRODUCTION METHOD FOR GRAIN-ORIENTED ELECTRICAL STEEL SHEET, AND PRODUCTION LINE

TECHNICAL FIELD

The present disclosure relates to a production method for a grain-oriented electrical steel sheet, and a production line.

BACKGROUND

A grain-oriented electrical steel sheet is a steel sheet excellent in magnetic properties having crystal texture (Goss orientation) in which the <001> orientation which is the easy magnetization axis of iron is highly accorded with the rolling direction of the steel sheet.

To achieve such a high degree of preferred orientation, for example, JP S50-16610 A (PTL 1) proposes a method of performing a heat treatment (aging treatment) on a steel sheet at low temperature during cold rolling.

JP H8-253816 A (PTL 2) discloses a technique of setting the cooling rate in hot-rolled sheet annealing or annealing before finish cold rolling (final cold rolling) to 30° C./s or more and performing, during the finish cold rolling, an aging treatment between passes at a steel sheet temperature of 150° C. to 300° C. for 2 min or more, at least twice.

JP H1-215925 A (PTL 3) proposes a (warm rolling) means of raising the steel sheet temperature to high temperature during cold rolling.

These various techniques are each a technique that, by keeping a steel sheet at an appropriate temperature during cold rolling or between cold rolling passes, causes carbon C and nitrogen N which are solute elements to form around dislocation cores introduced by rolling to thus suppress the movement of dislocations and induce shear deformation, thereby improving the rolled texture. The use of such a technique achieves the effect of, typically in primary recrystallized texture after cold rolling, reducing (111) fiber texture called y fiber ({111}<112>) and enhancing the frequency of presence of Goss orientation. Such a grain-oriented electrical steel sheet is produced by a method of, using a chemical composition that contains 4.5 mass % or less of Si and with which inhibitors such as MnS, MnSe, and AlN are formed, developing secondary recrystallization through the use of the inhibitors.

On the other hand, JP 2000-129356 A (PTL 4) proposes a technique (inhibitorless method) capable of developing secondary recrystallization without an inhibitor forming component.

CITATION LIST

Patent Literature

PTL 1: JP S50-16610 A
PTL 2: JP H8-253816 A
PTL 3: JP H1-215925 A
PTL 4: JP 2000-129356 A

SUMMARY

Technical Problem

The inhibitorless method is a method of developing secondary recrystallization by texture control using steel of higher purity. With this method, there is no need for high-temperature steel slab heating and accordingly low-cost production is possible. Meanwhile, since there is no secondary recrystallization accelerating effect by inhibitors, finer control is needed to create the texture. Particularly in a production method that involves a cold rolling process with a rolling reduction ratio of 80% or more, the differences in the conditions of the rolling process can greatly affect the properties.

Of the conditions of the rolling process, variation in rolling rate has significant influence, causing the effect of aging between passes or the effect of warm rolling to be inconstant and making it impossible to obtain stable magnetic properties in the same coil. Suppressing variation in rolling rate is a means for removing these problems. However, for example in the case where a tandem mill is used, the rolling rate is usually decreased for an operation of connecting a preceding coil and a succeeding coil by welding. Hence, it is difficult to completely eliminate variation in rolling rate.

It could therefore be helpful to provide a production method for a grain-oriented electrical steel sheet having stable magnetic properties in the same coil, together with a production line that can be used for the method.

Solution to Problem

Upon careful examination, we discovered that the problems stated above can be solved by associating the rolling rate and the steel sheet temperature in cold rolling. The present disclosure is based on this discovery.

Typically, the temperature of a steel sheet during rolling increases due to processing heat generated by the rolling, but simultaneously heat releasing by the rolls in contact with the steel sheet occurs. Hence, the temperature of the steel sheet after passing between the rolls has decreased by the heat releasing amount. Since the rolling reduction during rolling is the same regardless of the rolling rate, the amount of processing heat generated is the same even when the rolling rate decreases. When the rolling rate decreases, however, the time during which the steel sheet is in contact with the rolls increases, so that the amount of heat released by the rolls increases. Therefore, the steel sheet temperature after the rolling is lower in a part where the rolling rate decreases than in a part where the rolling rate is maintained. This can impair the uniformity of the texture of the steel sheet and cause variation in iron loss property in the final product.

With the production method according to the present disclosure, even in the case where the rolling rate is varied to half or less of a preset rolling rate set value $R_0$ (mpm) in cold rolling with a rolling reduction ratio of 80% or more where variation in rolling rate has significant influence, variation in texture in the same coil is suppressed and the secondary recrystallization behavior is stabilized by satisfying a specific condition for the steel sheet temperature.

The production line according to the present disclosure comprises a heating device and a cold mill in this order, and varies the heating by the heating device in conjunction with the rolling rate of the cold mill. This production line can be used to satisfy the specific condition for the steel sheet temperature even in the case where the rolling rate is varied to half or less of the preset rolling rate set value $R_0$ (mpm).

We thus provide:

[1] A production method for a grain-oriented electrical steel sheet, the production method comprising: hot rolling a steel slab to obtain a hot-rolled sheet, the steel slab having a chemical composition containing (consisting of), in mass %, C: 0.01% to 0.10%, Si: 2.0% to 4.5%, Mn: 0.01% to 0.5%, Al: less than 0.0100%, S: 0.0070% or less, Se:

0.0070% or less, N: 0.0050% or less, and O: 0.0050% or less, with a balance consisting of Fe and inevitable impurities; annealing the hot-rolled sheet to obtain a hot-rolled and annealed sheet; cold rolling the hot-rolled and annealed sheet one time, or two times or more with intermediate annealing being performed therebetween, to obtain a cold-rolled sheet having a final sheet thickness; and subjecting the cold-rolled sheet to primary recrystallization annealing and secondary recrystallization annealing, wherein in the cold rolling, a rolling reduction ratio is 80% or more at least one time out of the one time or two times or more, and a steel sheet temperature $T_0$ in ° C. while a rolling rate is a set value $R_0$ in mpm and a steel sheet temperature $T_1$ in ° C. while the rolling rate is less than or equal to $0.5\times R_0$ in mpm satisfy a formula:

$$T_1 \geq T_0 + 10° \text{ C.} \quad (1).$$

[2] The production method for a grain-oriented electrical steel sheet according to [1], wherein the cold rolling is performed using a tandem mill.

[3] The production method for a grain-oriented electrical steel sheet according to [2], wherein the hot-rolled and annealed sheet is heated on an entry side of the tandem mill so that the steel sheet temperature $T_0$ in ° C. while the rolling rate is the set value $R_0$ in mpm and the steel sheet temperature $T_1$ in ° C. while the rolling rate is less than or equal to $0.5\times R_0$ in mpm will satisfy the formula:

$$T_1 \geq T_0 + 10° \text{ C.} \quad (1).$$

[4] The production method for a grain-oriented electrical steel sheet according to any one of [1] to [3], wherein the chemical composition of the steel slab further contains, in mass %, one or more selected from the group consisting of Ni: 0.005% to 1.50%, Sn: 0.01% to 0.50%, Sb: 0.005% to 0.50%, Cu: 0.01% to 0.50%, Mo: 0.01% to 0.50%, P: 0.0050% to 0.50%, Cr: 0.01% to 1.50%, Nb: 0.0005% to 0.0200%, B: 0.0005% to 0.0200%, and Bi: 0.0005% to 0.0200%.

[5] A production line comprising a heating device and a cold mill in the stated order, wherein heating by the heating device varies in conjunction with a rolling rate of the cold mill.

[6] The production line according to [5], wherein the heating by the heating device varies in conjunction with the rolling rate of the cold mill so that a steel sheet temperature $T_0$ in ° C. while the rolling rate of the cold mill is a set value $R_0$ in mpm and a steel sheet temperature $T_1$ in ° C. while the rolling rate is less than or equal to $0.5\times R_0$ in mpm will satisfy a formula:

$$T_1 \geq T_0 + 10° \text{ C.} \quad (1).$$

[7] The production line according to [5] or [6], wherein a heating method used by the heating device is induction heating, electrical resistance heating, or infrared heating.

Advantageous Effect

It is thus possible to provide a production method for a grain-oriented electrical steel sheet having stable magnetic properties in the same coil. It is also possible to provide a production line that can be used to carry out the production method.

DETAILED DESCRIPTION

Figure 1:
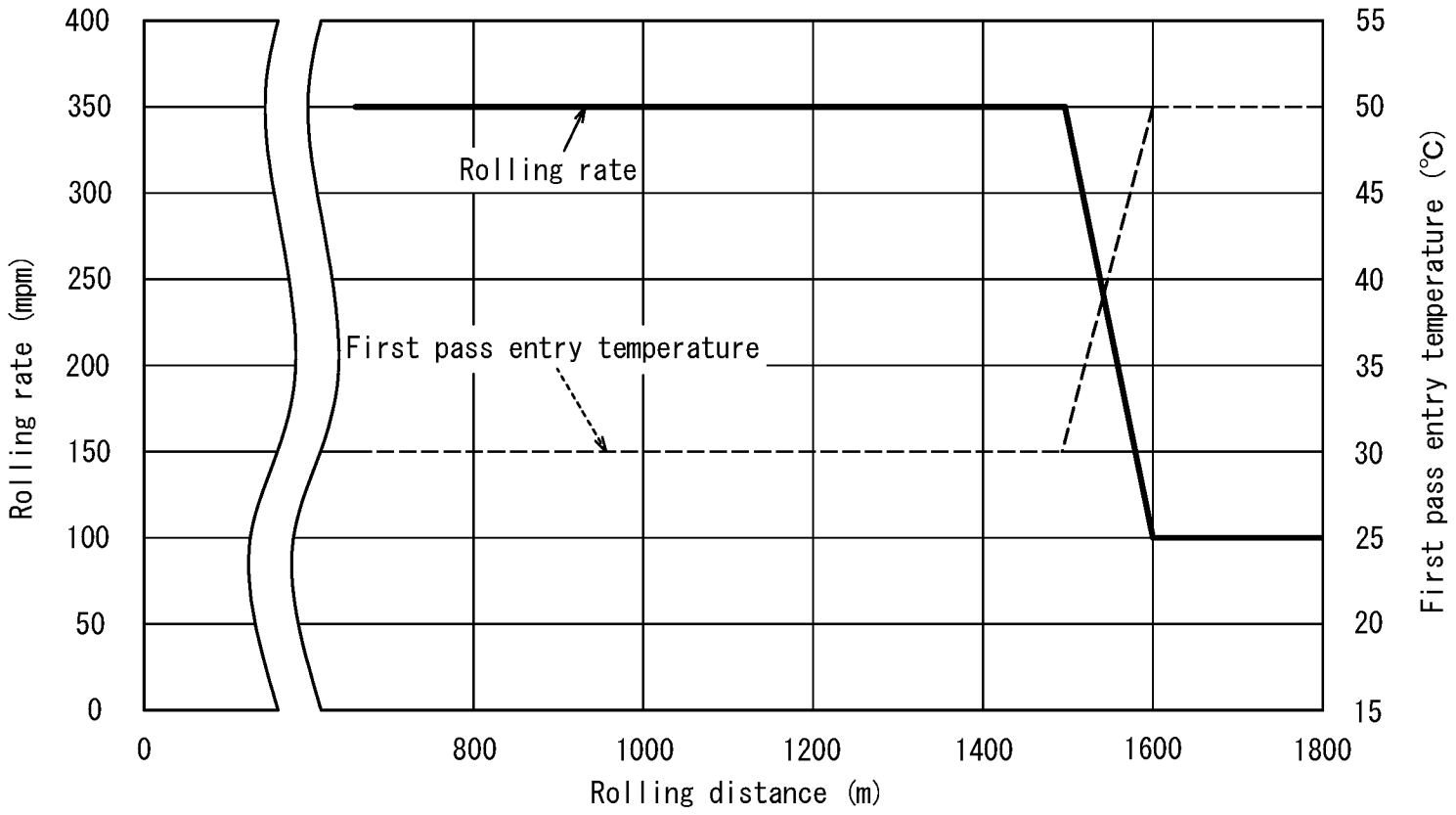
FIG. 1 is a chart illustrating the relationship between the rolling rate and the steel sheet temperature in cold rolling in a first example.

The presently disclosed techniques will be described in detail below.

<Steel Slab>

A steel slab used in the production method according to the present disclosure can be produced by a known production method. Examples of the known production method include steelmaking and continuous casting, and ingot casting and blooming.

The chemical composition of the steel slab is as follows. Herein, "%" with regard to the chemical composition is mass % unless otherwise noted.

C: 0.01% to 0.10%

C is an element necessary for rolled texture improvement. If the C content is less than 0.01%, the amount of fine carbide necessary for texture improvement is small and the effect is insufficient. If the C content is more than 0.10%, decarburization is difficult.

Si: 2.0% to 4.5%

Si is an element that enhances the electric resistance to improve the iron loss property. If the Si content is less than 2.0%, the effect is insufficient. If the Si content is more than 4.5%, cold rolling is extremely difficult.

Mn: 0.01% to 0.5%

Mn is an element useful in improving the hot workability. If the Mn content is less than 0.01%, the effect is insufficient. If the Mn content is more than 0.5%, the primary recrystallized texture degrades, making it difficult to obtain secondary recrystallized grains highly aligned with Goss orientation.

Al: Less than 0.0100%, S: 0.0070% or Less, Se: 0.0070% or Less

The production method according to the present disclosure is an inhibitorless method, and Al, S, and Se which are inhibitor forming elements are respectively reduced to Al: less than 0.0100%, S: 0.0070% or less, and Se: 0.0070% or less. If the contents of Al, S, and Se are excessively high, AlN, MnS, MnSe, and the like coarsened due to steel slab heating make the primary recrystallized non-uniform, and hinder secondary recrystallization. The contents of Al, S, and Se are preferably Al: 0.0050% or less, S: 0.0050% or less, and Se: 0.0050% or less, respectively. The contents of Al, S, and Se may each be 0%.

N: 0.0050% or Less

N is reduced to 0.0050% or less in order to prevent the action as an inhibitor and prevent the formation of Si nitride after purification annealing. The N content may be 0%.

O: 0.0050% or Less

O is sometimes regarded as an inhibitor forming element. If the O content is more than 0.0050%, coarse oxide hinders secondary recrystallization. The O content is therefore reduced to 0.0050% or less. The O content may be 0%.

While the essential components and the reduced components of the steel slab have been described above, the steel slab may optionally contain one or more selected from the following elements.

Ni: 0.005% to 1.50%

Ni has the effect of enhancing the uniformity of the hot-rolled sheet texture to improve the magnetic properties. In the case of adding Ni, the Ni content may be 0.005% or more from the viewpoint of achieving sufficient addition effect, and may be 1.50% or less in order to avoid degradation in magnetic properties caused by unstable secondary recrystallization.

Sn: 0.01% to 0.50%, Sb: 0.005% to 0.50%, Cu: 0.01% to 0.50%, Mo: 0.01% to 0.50%, P: 0.0050% to 0.50%, Cr: 0.01% to 1.50%, Nb: 0.0005% to 0.0200%, B: 0.0005% to 0.0200%, Bi: 0.0005% to 0.0200%

These elements each contribute to improved iron loss property. In the case of adding any of these elements, the content may be not less than its lower limit from the viewpoint of achieving sufficient addition effect, and may be not more than its upper limit from the viewpoint of sufficient growth of secondary recrystallized grains. Of these, Sn, Sb, Cu, Nb, B, and Bi are elements that are sometimes regarded as auxiliary inhibitors, and adding such elements beyond their upper limits is not preferable.

The balance of the chemical composition of the steel slab consists of Fe and inevitable impurities.

<Production Process>

The production method according to the present disclosure comprises: hot rolling a steel slab having the above-described chemical composition to obtain a hot-rolled sheet; annealing the hot-rolled sheet to obtain a hot-rolled and annealed sheet; cold rolling the hot-rolled and annealed sheet one time, or two times or more with intermediate annealing being performed therebetween, to obtain a cold-rolled sheet having a final sheet thickness; and subjecting the cold-rolled sheet to primary recrystallization annealing and secondary recrystallization annealing. Pickling may be performed before the cold rolling.

A steel slab having the above-described chemical composition is hot rolled to obtain a hot-rolled sheet. For example, the steel slab may be heated to a temperature of 1050° C. or more and less than 1300° C. and then hot rolled. Since inhibitor components are reduced in the steel slab in the present disclosure, there is no need to perform a high-temperature treatment of 1300° C. or more for complete dissolution. If the steel slab is heated to 1300° C. or more, the crystal texture becomes excessively large and a defect called scab may occur. Accordingly, the heating temperature is preferably less than 1300° C. The heating temperature is preferably 1050° C. or more, from the viewpoint of smooth rolling of the steel slab.

The other hot rolling conditions are not limited, and known conditions may be used.

The obtained hot-rolled sheet is annealed to obtain a hot-rolled and annealed sheet. The annealing conditions are not limited, and known conditions may be used.

The obtained hot-rolled sheet is subjected to hot-rolled sheet annealing, and then subjected to cold rolling. The cold rolling may be performed one time, or two times or more with intermediate annealing being performed therebetween. In at least one cold rolling, rolling with a rolling reduction ratio of 80% or more is performed. Rolling with a rolling reduction ratio of 80% or more is advantageous in that the degree of preferred orientation of texture can be enhanced to create texture advantageous for magnetic properties, but variation in rolling rate has significant influence. According to the present disclosure, such influence can be reduced, and a grain-oriented electrical steel sheet having stable magnetic properties in the same coil can be obtained by a production method that involves cold rolling with a rolling reduction ratio of 80% or more.

The rolling rate in cold rolling is normally set beforehand based on various conditions such as production volume and mill capacity. In principle, a preset rolling rate is used in the same coil. In some cases, however, the rolling rate needs to be decreased in the longitudinal direction due to a shape defect of the coil subjected to the cold rolling, edge cracking, a scab defect in the hot rolling process, etc. Moreover, in the case where a tandem mill is used for the cold rolling, the rolling rate is decreased for, for example, an operation of welding a preceding coil and a succeeding coil. Accordingly, the actual rolling rate can vary from a preset rolling rate set value $R_0$ (mpm), and there is a possibility that the measured value is half or less of $R_0$ in the foregoing situations. A part of the coil to which the preset rolling rate set value $R_0$ (mpm) is applied is also referred to as "steady part", and a part of the coil where the rolling rate is decreased to half or less of the set value $R_0$ (mpm) is also referred to as "deceleration part". A deceleration part in welding is typically 5% to 20% of the total length of the coil from both ends. The preset rolling rate set value $R_0$ (mpm) can be applied to the other part unless there is a special circumstance such as a shape defect of the coil.

In the production method according to the present disclosure, the steel sheet temperature $T_0$ (° C.) of the steady part and the steel sheet temperature $T_1$ (° C.) of the deceleration part satisfy the following formula:

$$T_1 \geq T_0 + 10° \text{ C.} \quad (1).$$

Thus, variation in texture in the same coil is suppressed, and the secondary recrystallization behavior is stabilized.

Preferably, the following formula:

$$T_1 \geq T_0 + 15° \text{ C.} \quad (1')$$

is satisfied from the viewpoint of uniform texture in the same coil.

No upper limit is placed on $T_1$ (° C.), and the upper limit may be set as appropriate. For example, in the case of using rolling oil, $T_1$ (C) is such temperature at which the rolling oil exhibits sufficient performance. $T_1$ (° C.) may be, for example, 265° C. or less.

$T_1$ (° C.) may be less than or equal to $T_0$+100° C., in addition to satisfying the foregoing formula (1).

The rolling rate may be assumed to be the rate at any position in the rolling process. For example, the rolling rate may be the rate on the exit side of the mill. In this case, the rolling rate set value $R_0$ (mpm) is not limited, and may be, for example, 200 (mpm) or more, and preferably 600 (mpm) or more. The upper limit varies depending on the mill, but is preferably 2000 (mpm) or less because an increase of the rolling rate promotes an increase in deformation resistance.

The rolling rate of the deceleration part is the rate at the same position as the set value. The deceleration part is the part where the rolling rate decreases to half ($0.5 \times R_0$) or less of the set value $R_0$ (mpm), and the rolling rate of the deceleration part is typically $0.1 \times R_0$ (mpm) or more and $0.5 \times R_0$ (mpm) or less.

The rolling rate of the steady part is the rolling rate set value $R_0$ (mpm), with a tolerance of about ±10%. The expression "the rolling rate is the set value $R_0$ (mpm)" includes the case where a measured value of the rolling rate is $R_0$ (mpm)$\pm 0.1 \times R_0$ (mpm).

The steel sheet temperature may be assumed to be the temperature at any position in the rolling process. For example, the steel sheet temperature may be the temperature on the entry side of the mill. In the case where the mill is provided with a heating device on its entry side, the steel sheet temperature is the temperature on the exit side of the heating device. Preferably, the steel sheet temperature immediately after leaving the heating device is used, from the viewpoint of stable control. To which is the steel sheet temperature of the steady part may set as appropriate according to the composition of the steel slab, the desired properties of the steel sheet, and the like, and may be, for example, 20° C. or more, and preferably 50° C. or more. The upper limit of $T_0$ may be set as appropriate. For example, in the case of using rolling oil, the upper limit may be set in consideration of such temperature at which the rolling oil exhibits sufficient performance, and may differ depending on the type of the rolling oil. To may be, for example, 250° C. or less, and preferably 150° C. or less.

The foregoing formulas (1) and (1') are not applied while the rolling rate is increasing or decreasing, such as during the transition from the steady part to the deceleration part or from the deceleration part to the steady part.

Figure 2:
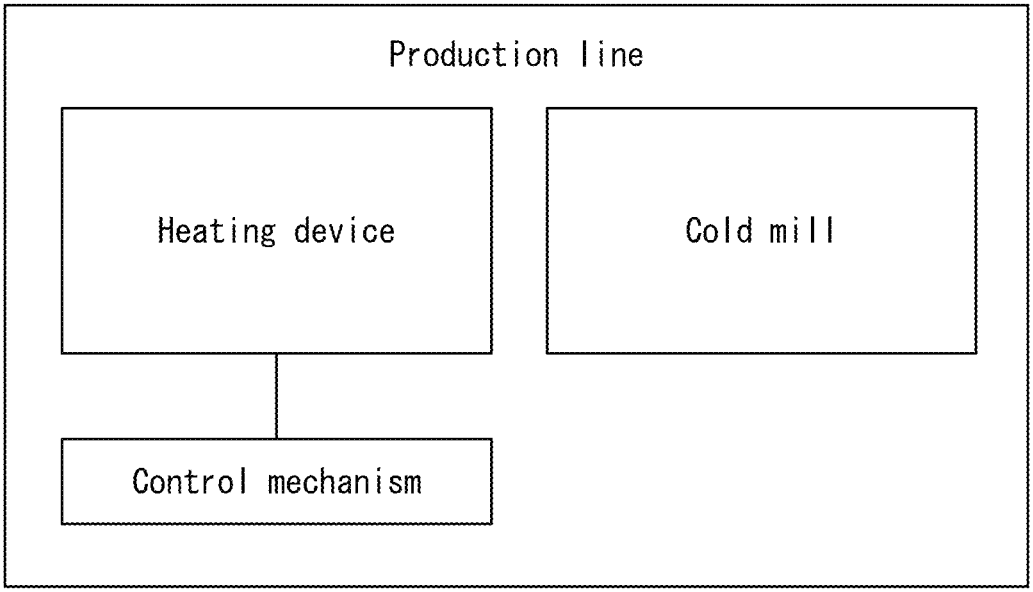
FIG. 2 illustrates a block diagram of a production line

The production method according to the present disclosure can be carried out using a production line that comprises a heating device and a cold mill in this order and varies the heating by the heating device in conjunction with the rolling rate of the cold mill, as shown in FIG. 2.

The heating by the heating device that varies in conjunction with the rolling rate is performed so as to satisfy the foregoing formula (1) or (1') according to the change of the rolling rate. The heating can be performed in consideration of the change of the output of the heating device as a result of the rate change. Normally, a decrease of the rolling rate is linked with an increase of the output of the heating device, and an increase of the rolling rate is linked with a decrease (including output off) of the output of the heating device. This includes such operation that increases the output of the heating device when the rolling rate falls below a certain value and decreases or turns off the output of the heating device when the rolling rate exceeds a certain value. Depending on the specifications of the heating device, the rolling rate difference can be very large and the heating time in the deceleration part can be extremely long. This may make it necessary to decrease the output of the heating device and control the temperature $T_1$. The temperature $T_1$ is preferably within the range in which the performance of rolling oil is maintained. It is preferable to perform such control by a control mechanism that reflects variation in rolling rate to the output control of the heating device.

The heating method of the heating device is not limited, but heating methods such as induction heating, electrical resistance heating, and infrared heating are preferable because rapid heating is possible and synchronization with the rolling rate is easy.

The phenomenon that the steel sheet temperature decreases when the rolling rate decreases is substantially the same regardless of which mill is used. The decrease in the temperature has a greater influence on the texture when performing rolling in which the aging time between passes is short and the effect of warm rolling by aging is unlikely to be achieved, such as when a tandem mill is used. The production method according to the present disclosure is therefore advantageous in the case of performing cold rolling using a tandem mill.

The heating device is preferably located immediately before the first stand of the tandem mill. In the case where the heating is performed immediately before the first stand, the influence of the heating is exerted on all stands during rolling, and the texture can be improved more efficiently than in the case where the heating is performed halfway between stands.

The obtained cold-rolled sheet having the final sheet thickness (also referred to as "final cold-rolled sheet") is subjected to primary recrystallization annealing and secondary recrystallization annealing, to obtain a grain-oriented electrical steel sheet. The final cold-rolled sheet is subjected to primary recrystallization annealing and then an annealing separator is applied to the surface of the steel sheet, after which the final cold-rolled sheet can be subjected to secondary recrystallization annealing.

The primary recrystallization annealing is not limited, and a known method may be used. The annealing separator is not limited, and a known annealing separator may be used. For example, water slurry containing magnesia as a main agent and optionally containing additives such as $TiO_2$ may be used. An annealing separator containing silica, alumina, etc. may also be used.

The secondary recrystallization annealing is not limited, and a known method may be used. In the case where a separator containing magnesia as a main agent is used, a coating mainly composed of forsterite is formed with secondary recrystallization. In the case where a coating mainly composed of forsterite is not formed after the secondary recrystallization annealing, any of various additional treatments such as formation of a new coating and surface smoothing may be performed. In the case of forming an insulating coating having tension, the type of the insulating coating is not limited, and any known insulating coating may be used. A method of applying an application liquid containing phosphate-chromate-colloidal silica to the steel sheet and baking it at about 800° C. is preferable. For such method, for example, see JP S50-79442 A and JP S48-39338 A. The shape of the steel sheet may be adjusted by flattening annealing. Flattening annealing also serving as baking of the insulating coating may be performed.

EXAMPLES

First Example

Steel slabs containing, in mass %, C: 0.04%, Si: 3.2%, Mn: 0.05%, Al: 0.005%, and Sb: 0.01% with the contents of S, Se, N, and O each being reduced to 50 ppm or less, with the balance consisting of Fe and inevitable impurities, were each heated to 1180° C., hot rolled to obtain a hot-rolled coil of 2.0 mm, and then subjected to hot-rolled sheet annealing at 1050° C. for 50 sec. Following this, the hot-rolled and annealed sheet was roll-reduced to a sheet thickness of 0.23 mm using a tandem mill (roll diameter: 300 mmo, four stands), to obtain a cold-rolled sheet.

Here, the rolling rate set value was 350 mpm (steady part), and the rolling rate was decreased to 100 mpm at the lead and tail ends (deceleration part). The lead and tail ends herein are each a part of 200 m from the corresponding end of the coil with a total length of 1800 m in the longitudinal direction.

In the cold rolling, a mill provided with an induction heating device on its first pass entry side was used, and the output to the induction heating device was changed according to the change of the rolling rate to control the steel sheet temperature. The steel sheet temperature herein is the temperature of the steel sheet immediately after leaving the heating device. Specifically, in the deceleration part, active heating was performed by the induction heating device to control the steel sheet temperature to 50° C. In the steady part, rolling was performed at room temperature (25° C.).

FIG. 1 illustrates changes in rolling rate and steel sheet temperature. The horizontal axis represents the distance from the lead end of the coil (rolling distance (m)).

The obtained cold-rolled sheet was subjected to primary recrystallization annealing with a soaking temperature of 850° C. and a soaking time of 90 sec.

An annealing separator containing MgO as a main agent was applied to the obtained primary recrystallization annealed sheet, and the primary recrystallization annealed sheet was subjected to secondary recrystallization annealing with a maximum arrival temperature of 1190° C. in annealing and a holding time of 6 hr at the maximum temperature.

A coating liquid containing phosphate as a main agent was applied to the obtained secondary recrystallization annealed sheet, and annealing was performed at 900° C. for 120 sec, which served as both baking and stress relief. The maximum iron loss difference ($\Delta W_{17/50}$ (W/kg)) between the deceleration part (100 mpm) and the steady part (350 mpm) in the rolling in the obtained steel sheet was 0.008 W/kg.

For comparison, rolling was performed at room temperature (25° C.) without heating the deceleration part. The maximum iron loss difference ($\Delta W_{17/50}$) calculated in the same way as above was 0.017 W/kg.

Second Example

Steel slabs containing, in mass %, C: 0.05%, Si: 3.3%, Mn: 0.06%, Al: 0.005%, Cr: 0.01%, and P: 0.01% with the contents of S, Se, and O each being reduced to less than 50 ppm and the content of N being reduced to less than 35 ppm, with the balance consisting of Fe and inevitable impurities, were each heated to 1100° C., then hot rolled to obtain a hot-rolled coil of 2.0 mm in sheet thickness, and then subjected to hot-rolled sheet annealing at 1050° C. for 60 sec. Following this, the hot-rolled and annealed sheet was roll-reduced to 0.25 mm using a tandem mill (roll diameter: 380 mmo, four stands), to obtain a cold-rolled sheet.

In the cold rolling, while varying the rolling rate in the same coil, the steel sheet temperature was changed using an induction heating device provided on the first pass entry side of the mill. The rolling conditions are shown in Table 1. In the tandem mill, the rolling rate changes for each pass. The rolling rate shown in Table 1 is the rate on the final stand exit side of the mill. The rolling reduction ratio of the first stand (first pass) was 32%.

The obtained cold-rolled sheet was subjected to primary recrystallization annealing with a soaking temperature of 800° C. and a soaking time of 50 sec.

From the primary recrystallization annealed sheet, ten test pieces of 30 mm×30 mm were cut out from the part (deceleration part) where the steel sheet temperature was changed by induction heating during the cold rolling, and X-ray inverse strength measurement was performed.

An annealing separator containing MgO as a main agent was then applied to the primary recrystallization annealed sheet, and the primary recrystallization annealed sheet was subjected to secondary recrystallization annealing with a maximum arrival temperature of 1210° C. in annealing and a holding time of 3 hr at the maximum temperature.

An application liquid containing phosphate-chromate-colloidal silica at a weight ratio of 3:1:2 was applied to the obtained secondary recrystallization annealed sheet, and the secondary recrystallization annealed sheet was subjected to a baking treatment at 800° C. for 30 sec. Further, stress relief annealing at 800° C. for 3 hr was performed. After this, ten test pieces of 30 mm×280 mm were cut out from each of the steady part and the deceleration part, and the iron loss $W_{17/50}$ (W/kg) was measured by the Epstein test.

TABLE 1

| | Rolling rate (mpm) | | | Steel sheet temperature on entry side of first pass of rolling (° C.) | | | Steel sheet temperature after first pass (calculated value, ° C.) | | |
|---|---|---|---|---|---|---|---|---|---|
| Coil | Steady part | Deceleration part | Deceleration part/steady part | Steady part | Deceleration part | Temperature difference | Steady part | Deceleration part | Temperature difference |
| 1 | 300 | 200 | 0.67 | 25 | 25 | 0 | 100 | 90 | 10 |
| 2 | 400 | 200 | 0.50 | 25 | 25 | 0 | 106 | 90 | 16 |
| 3 | 400 | 200 | 0.50 | 25 | 35 | 10 | 106 | 97 | 9 |
| 4 | 600 | 200 | 0.33 | 25 | 25 | 0 | 111 | 90 | 21 |
| 5 | 600 | 200 | 0.33 | 25 | 45 | 20 | 111 | 108 | 3 |
| 6 | 600 | 200 | 0.33 | 45 | 65 | 20 | 129 | 122 | 7 |
| 7 | 600 | 200 | 0.33 | 60 | 80 | 20 | 143 | 138 | 5 |
| 8 | 700 | 150 | 0.21 | 25 | 25 | 0 | 113 | 81 | 32 |
| 9 | 700 | 150 | 0.21 | 50 | 50 | 0 | 136 | 104 | 32 |
| 10 | 700 | 150 | 0.21 | 50 | 75 | 25 | 136 | 126 | 10 |
| 11 | 800 | 100 | 0.13 | 50 | 50 | 0 | 137 | 87 | 50 |
| 12 | 800 | 100 | 0.13 | 50 | 100 | 50 | 137 | 134 | 3 |

| | (110) strength after primary recrystallization | | | Product sheet $W_{17/50}$ (W/kg) | | | |
|---|---|---|---|---|---|---|---|
| Coil | Steady part | Deceleration part | Strength difference | Steady part | Deceleration part | Magnetism difference | Remarks |
| 1 | 0.45 | 0.49 | 0.04 | 0.854 | 0.857 | 0.003 | Reference Example |
| 2 | 0.33 | 0.49 | 0.16 | 0.865 | 0.852 | 0.013 | Comparative Example |
| 3 | 0.50 | 0.47 | 0.03 | 0.859 | 0.852 | 0.007 | Example |
| 4 | 0.68 | 0.48 | 0.20 | 0.845 | 0.857 | 0.012 | Comparative Example |
| 5 | 0.68 | 0.68 | 0.00 | 0.840 | 0.843 | 0.003 | Example |
| 6 | 0.76 | 0.80 | 0.04 | 0.838 | 0.835 | 0.003 | Example |
| 7 | 0.91 | 0.93 | 0.02 | 0.824 | 0.822 | 0.002 | Example |
| 8 | 0.65 | 0.51 | 0.14 | 0.846 | 0.858 | 0.012 | Comparative Example |
| 9 | 0.85 | 0.72 | 0.13 | 0.829 | 0.840 | 0.011 | Comparative Example |
| 10 | 0.87 | 0.90 | 0.03 | 0.826 | 0.821 | 0.005 | Example |
| 11 | 0.84 | 0.72 | 0.12 | 0.824 | 0.839 | 0.015 | Comparative Example |
| 12 | 0.85 | 0.92 | 0.07 | 0.827 | 0.820 | 0.007 | Example |

As can be understood from Table 1, in each Example, variation in texture in the same coil was suppressed, and the difference in magnetic properties was small.

Table 1 shows the calculated value of the steel sheet temperature after one stand (first pass). In each Example, the temperature difference between the steady part and the deceleration part was small. The calculated value of the steel sheet temperature herein takes into account the processing heat generated in the steel sheet by the rolling, the frictional heat generated between the rolls and the steel sheet, and the roll heat releasing by the rolls in contact with the steel sheet.

Third Example

Steel slabs containing the components shown in Table 2 were each heated to 1200° C., then hot rolled to obtain a hot-rolled coil of 2.2 mm in sheet thickness, and then subjected to hot-rolled sheet annealing at 950° C. for 30 sec. Following this, the hot-rolled and annealed sheet was roll-reduced to 0.27 mm using a tandem mill (roll diameter: 280 mmo, four stands), to obtain a cold-rolled sheet.

Here, the rolling rate set value was 700 mpm, and the rolling rate was decreased to 150 mpm in the deceleration part. Using a heating device located immediately before the mill entry side and having an induction heating coil, heating was performed so that the temperature of the steel strip immediately after leaving the heating device would be 50° C. while the rolling rate was the set value and would be 75° C. in the deceleration part.

The obtained cold-rolled sheet was subjected to primary recrystallization annealing with a heating rate of 200° C./s from 300° C. to 700° C., a soaking temperature of 850° C., and a soaking time of 40 sec.

An annealing separator containing MgO as a main agent was applied to the obtained primary recrystallization annealed sheet, and the primary recrystallization annealed sheet was subjected to secondary recrystallization annealing with a maximum arrival temperature of 1210° C. in annealing and a holding time of 3 hr at the maximum temperature.

An application liquid containing phosphate-chromate-colloidal silica at a weight ratio of 3:1:2 was applied to the obtained secondary recrystallization annealed sheet, and flattening annealing was performed at 850° C. for 30 sec. After this, test pieces of 30 mm×280 mm were cut out from each of the steady part and the deceleration part so as to be 500 g or more in total weight, and the iron loss $W_{17/50}$ (W/kg) was measured by the Epstein test. The results are shown in Table 2.

TABLE 2

| Steel* | Si (%) | C (%) | Mn (%) | Al (ppm) | S (ppm) | Se (ppm) | N (ppm) | Additional element (%) | (110) strength after primary recrystallization Steady part |
|---|---|---|---|---|---|---|---|---|---|
| A | 3.34 | 0.03 | 0.05 | 70 | 30 | 5 | 40 | — | 0.85 |
| B | 3.35 | 0.04 | 0.04 | 60 | 40 | 5 | 40 | Cr: 0.03<br>Mo: 0.02 | 0.82 |
| C | 3.30 | 0.04 | 0.06 | 50 | 20 | 60 | 30 | Sb: 0.03 | 0.88 |
| D | 3.32 | 0.05 | 0.06 | 50 | 20 | 5 | 30 | Ni: 0.02 | 0.80 |
| E | 3.37 | 0.05 | 0.03 | 80 | 40 | 5 | 40 | Cu: 0.02<br>Sn: 0.01 | 0.90 |
| F | 3.38 | 0.04 | 0.04 | 40 | 30 | 5 | 30 | Cr: 0.04<br>P: 0.01<br>Nb: 0.002 | 0.91 |
| G | 3.30 | 0.04 | 0.04 | 70 | 50 | 5 | 40 | B: 0.001 | 0.87 |
| H | 3.31 | 0.03 | 0.05 | 50 | 20 | 20 | 30 | P: 0.06<br>Bi: 0.001 | 0.86 |

| Steel* | (110) strength after primary recrystallization | | Product sheet $W_{17/50}$ (W/kg) | | | Remarks |
|---|---|---|---|---|---|---|
| | Deceleration part | Strength difference | Steady part | Deceleration part | Magnetism difference | |
| A | 0.89 | 0.04 | 0.927 | 0.922 | 0.005 | Example |
| B | 0.86 | 0.04 | 0.918 | 0.912 | 0.006 | Example |
| C | 0.91 | 0.03 | 0.920 | 0.914 | 0.006 | Example |
| D | 0.82 | 0.02 | 0.917 | 0.914 | 0.003 | Example |
| E | 0.93 | 0.03 | 0.916 | 0.911 | 0.005 | Example |
| F | 0.93 | 0.02 | 0.913 | 0.910 | 0.003 | Example |
| G | 0.91 | 0.04 | 0.924 | 0.919 | 0.005 | Example |
| H | 0.91 | 0.05 | 0.922 | 0.915 | 0.007 | Example |

*O content in each of A to H is 50 ppm or less.

As can be understood from Table 2, even in the case where steel slabs containing additional elements were used, variation in texture in the same coil was suppressed and the same iron loss improving effect was achieved.

The invention claimed is:

1. A production line comprising: a heating device; a cold mill arranged after the heating device in a rolling direction; and a control mechanism, wherein the control mechanism is configured to control an output of the heating device so that heating by the heating device maintains a steel sheet temperature $T_0$ in ° C. at an entry side of the cold mill while the rolling rate of the cold mill is a set value $R_0$ in meters per minute (mpm) and maintains a steel sheet temperature $T_1$ in ° C. at the entry side of the cold mill while the rolling rate is less than or equal to $0.5\times R_0$ in mpm, wherein the steel sheet temperatures $T_0$ and $T_1$ satisfy a formula:

$$T_1 \geq T_0 + 10^\circ \text{ C.} \quad (1), \text{ and}$$

wherein the cold mill is a tandem mill.

2. The production line according to claim 1, wherein a heating method used by the heating device is induction heating, electrical resistance heating, or infrared heating.

* * * * *